United States Patent [19]

Bobkowicz

[11] 4,244,174

[45] Jan. 13, 1981

[54] POY YARN COMPOSITIONS

[75] Inventor: Andrew J. Bobkowicz, Montreal, Canada

[73] Assignee: The Bobtex Corporation, Ltd., Montreal, Canada

[21] Appl. No.: 953,967

[22] Filed: Oct. 23, 1978

[30] Foreign Application Priority Data

Nov. 3, 1977 [GB] United Kingdom ..... 45677/77

[51] Int. Cl.[3] ..... D02G 3/36; D02G 3/40

[52] U.S. Cl. ..... 57/232; 57/7; 57/224; 57/295; 264/290.2

[58] Field of Search ..... 57/3, 5, 6, 7, 224, 57/225, 226, 232, 243, 250, 258, 286, 287, 288, 292, 295, 297, 309, 310, 315, 296, 298; 28/240, 246; 264/290.2, 290.5

[56] References Cited

U.S. PATENT DOCUMENTS

| | | | |
|---|---|---|---|
| 3,621,646 | 11/1971 | Bobkowicz | 57/5 X |
| 3,840,633 | 10/1974 | Barbe et al. | 264/290.5 X |
| 3,844,097 | 10/1974 | Bobkowicz et al. | 57/292 X |
| 3,848,403 | 11/1974 | Bobkowicz et al. | 57/5 |
| 3,924,396 | 12/1975 | Bobkowicz et al. | 57/7 X |
| 3,987,612 | 10/1976 | Bobkowicz | 57/5 |
| 4,115,992 | 9/1978 | Van Tijn | 57/297 |

*Primary Examiner*—Donald Watkins

*Attorney, Agent, or Firm*—Robert J. Schaap; Eric Fincham

[57] ABSTRACT

The instant specification describes an improved method for the manufacture of composite yarns having a central carrier with fibers or filaments adhered thereto. The method includes the step of using a partially oriented yarn as the carrier material and drawing or stretching the partially oriented yarn immediately prior to or as the yarn passes through an extruder to be coated with a binding material.

17 Claims, No Drawings

POY YARN COMPOSITIONS

The present invention relates to yarns and more particularly, relates to an improved method suitable for the manufacture of composite or multi-component yarns.

Recent advances in the textile field include teachings relating to the formation of composite and/or multi-component yarns which are formed of a substrate of binding material, such as a polymeric substance, with the binding material having an outer yarn-forming material partially embedded therein or adhered thereto. The yarn-forming material may be selected from many such materials known to those skilled in the art and may include, for example, filaments, yarns, fibrids, staple length fibers, etc. In one embodiment, a carrier has a sheath of polymeric material thereabout with the yarn-forming material embedded in the polymeric sheath. Thus, there may be three distinct components forming the yarn-the central carrier, the binding material comprising the polymeric sheath about the carrier, and the outer yarn-forming material or fibers embedded in the polymeric sheath. Such yarns along with methods and apparatuses for producing the same have been described in, among others, Canadian Pat. Nos. 833,433; 880,988 and 983,694.

Generally, the manufacture of composite yarns includes the practice of supplying a carrier filament, passing the carrier filament through an extruder wherein it is coated with a molten polymeric resin, and subsequently juxtaposing fibers to the coated carrier while the same is in a tacky condition.

The carrier filament, as taught in the above-mentioned patents and as is known in the art, may be of many different suitable materials depending on the final yarn desired. In practice, the carrier is generally formed of a polymeric material in the form of a filament of the same. Such filaments wound on suitable bobbins are readily available in the marketplace and suitable materials include polyesters, polyamides, polyolefins, etc.

In the practice of the manufacture of composite yarns, the carrier is preferably run through an extruder wherein it is coated with the tacky resin — in effect, a polymeric sheath is extruded about the carrier as it passes therethrough. Subsequently, fibers are juxtaposed to the coated carrier.

While the process for manufacturing the composite yarns has substantial advantages over conventional techniques such as ring and pot spinning, the theoretical maximum speeds have not always been achieved. Thus, one problem which has been encountered is that the sheath about the filament, when extruded at the high speeds desired, shows breaks therein. Such breaks in the polymeric sheath will show in the final yarn as fibers do not adhere thereto.

Accordingly, it is an object of the present invention to provide an improved method for the manufacture of composite yarns wherein better adhesion of the fibers to the carrier is achieved.

According to the present invention, in a method of manufacturing a composite yarn wherein a carrier which is coated with a binding material, there is provided the improvement comprising the steps of supplying a carrier of a partially oriented material and subsequently stretching and orienting said material, and coating said carrier with a binding material while being drawn or immediately thereafter.

In essence, it has been found that by employing an undrawn filament or yarn as the carrier in the manufacture of a composite or multi-component yarn, and drawing the undrawn carrier just prior to or during the period of time at which the carrier passes through the extruder to be coated with the binder material, one achieves better fiber adhesion.

As will be appreciated by those skilled in the art, the undrawn carrier may be of many different suitable materials. Thus, polyesters, polyamides, polyolefins, etc. may form the undrawn or partially oriented carrier. The carrier may be drawn or oriented by many different means known to those knowledgeable in this art—godet, rolls and the like may be employed.

In one particularly advantageous arrangement, a two-stage draw may be employed. Again means of achieving such drawing are well known to those skilled in the art. In one embodiment, a source of undrawn or partially oriented carrier material may be provided and the same led over a tension wheel to an extruder and subsequently a positively driven roll. Between the source of the carrier material and the tension wheel, tension may be applied to the yarn by means of a suitable weight. This would constitute a first drawing stage while a second drawing stage or zone would occur between the controllable tension wheel and the positively driven roll. Depending on the material being employed as the carrier, the various parameters of the process may be adjusted to give the desired results. Thus, the first stage drawing may be such as to provide a substantial amount of the total drawing with the second stage between the tension wheel and positively driven roll contributing a minor amount. Alternatively, the reverse arrangement may be employed.

The amount of drawing of the unoriented or partially oriented carrier material will also vary depending on the particular material and the operating parameters of the process. It suffices to say that the drawing may vary between 1.5:1 and 9:1 or even higher. Again, such parameters can be readily established by those skilled in the art depending on the materials involved and the final properties of the yarn.

In the instant specification, the carrier material may be either of the undrawn variety or partially oriented. In practice, most carrier materials as commercially available are at least partially oriented, although any inherent material being capable of being oriented according to the method of the present invention would be suitable. Furthermore, it will be understood that the binding component may be any material suitable and known in the art. Thus, many different polymeric materials have been employed as the binding agent. Similarly, the outer yarn component may be selected from those materials known to those skilled in this art. The outer yarn component may be in the form of fibers, fibrids, continuous filaments, discontinuous filaments, staple fibers, yarns of filaments or fibers, etc.

Having thus generally described the invention, reference will be made to the accompanying Examples thereof.

EXAMPLES 1 to 6

Yarns were produced as set forth in Table 1 on a Bobtex Mark I ICS machine, manufactured by the Bobtex Corporation. The partially oriented carrier material was fed to a tension wheel and then through the extruder to a positively driven roll. The tension exerted on the carrier was as follows:

| No. of carrier bundles | FOY[1] TENSION (g) | | POY[2] TENSION (g) | |
|---|---|---|---|---|
| | Front | Back | Front | Back |
| 2 | 70 | 20 | 70 | 70 |
| 3 | 100 | 50 | 100 | 200 |

[1]150 den polyester multifilament fully oriented yarn
[2]den polyester multifilament partially oriented yarn.

The partially oriented yarn was drawn from 25 tex to 17 tex; an order of approximately 1.5:1.

TABLE 1

| | ICS YARNS EXAMPLES | | | | | |
|---|---|---|---|---|---|---|
| Example No. | 1 | 2 | 3 | 4 | 5 | 6 |
| Count (tex) | 75 | 80 | 95 | 89 | 190 | 140 |
| Composition | | | | | | |
| Fiber % | W 55 | W 57 | A 45 | A 44 | V 60 | W/MA 27 |
| Polymer % | PPA 23 | PPA 22 | PPA 19 | PPA 19 | PPA 14 | SA 49 |
| Filament % | PETP 22 | PETP 21 | PETP 36 | PETP 37 | PETP 26 | Glass 24 |
| No. of Carriers | 1 × POY | 1 × FOY | 2 × POY | 2 × POY | 3 × POY | 1 |
| Speed (ft./min.) | 1450 | 2034 | 2150 | 2650 | 2040 | 2040 |
| Run Tension % | 36 | 65 | 30 | 40 | 150 | 50 |
| Efficiency[1] % | 85 | 85 | 90 | 90 | 90 | 70 |
| Adhesion Index[2] | 3 | 1 | 4 | 5 | 5 | 5 |
| Breaking Str. (g.) | 633 | 650 | 1275 | 870 | 1050 | 2500 |
| Elongation % | 30 | 29 | 21 | 26 | 46 | 3.3 |
| Shrinkage (%)[3] | 7 | 5 | 5 | 7 | 13 | 0 |

[1]Operating run efficiency achievable.
[2]Measure of ability to strip the fiber/polymer sheath from the carrier core filament on a scale of 1 to 5; 1 signifies easy sliding off with almost no resistance, 5 signifies no stripping, the force required to strip being in excess of the total yarn breaking strength.
[3]Shrinkage in relaxed form, dry heat 15 min. at 230° F., average of 3 measurements.
Abbreviations:
A - Acrylic
V - Viscose
SA - Saran Alloy
PPA - PP alloy copolymer
PP - Polypropylene
W - Wool
MA Modacrylic
PETP - polyester As will be seen the surface adhesion to the undrawn or partially oriented carrier material is significantly greater than the adhesion with the fully oriented yarn or carrier. The amount of elongation and shrinkage in the final yarn product can be regulated by using an undrawn or partially oriented carrier.

It has been found that the superior performance of partially oriented or undrawn yarn resides in its ability to withstand the stress of running—the wider plasticity region of the partially oriented yarn on the stress-strain curve allows it to better withstand the stresses and strains applied to it thereby yielding higher efficiencies. Furthermore, one obtains a higher twist retention in the final yarn product due to intermolecular slippage and permanent carrier deformation through torque introduced axial rotation, e.g. twisting.

In addition to the above advantages, the use of partially oriented or undrawn yarn or carrier is useful in that the partially oriented carrier is only partially processed and is thus economically cheaper. Furthermore, since a larger package of an undrawn carrier is available commercially, one obtains longer uninterrupted production runs, less package handling, longer knotless runs, less splicing, less down time and higher operation efficiency.

It will be understood that the above-described examples are for purposes of illustration only and that many modifications may be made thereto. Thus, when the term "fiber" is employed herein, it is understood that the same includes many different types of materials which could be applied to the outer surface of the final yarn product. Thus, not only staple fibers may be used, but filaments, yarns formed of fibers, yarns formed of filaments, etc.

As employed above, the term "partially oriented" or "undrawn" refers to yarns or filaments which are in a partially oriented state. The commercially available yarns or filaments are oriented to a certain degree depending on the particular material involved—at least a 20% orientation is normal. The drawing or orientation step according to the present invention may either be a full one or a partial one depending on the particular yarn being desired.

In summary of the above, the process of the present invention is applicable to any suitable composite yarn wherein the carrier is capable of being further oriented or drawn prior to or as it passes through the extruder to be coated. In other words, an in situ deformation of the carrier occurs through a torque introduced axial rotation and which has been found to lead to the improved results above.

The drawing or orientation, in combination with the in situ deformation of the carrier, as previously discussed, provides a greater processability of the yarn. In this connection, it will be understood that the twisting step is not essential to the products of the invention, but represents a preferred embodiment thereof.

It will be further noted by those skilled in the art that certain embodiments of the invention will include products wherein the center core or carrier is not fully drawn or oriented—i.e. only a partial drawing takes place representing less than the maximum possible orientation.

I claim:

1. In a method of manufacturing a yarn product having a carrier which is subsequently coated with a binding material and an outer yarn component, the improvement comprising the steps of supplying a carrier of a partially oriented or undrawn material, drawing and orienting said carrier, and coating said carrier with a binding material just after or during the period of time that the carrier is being drawn and oriented.

2. The method of claim 1 wherein the step of coating said carrier occurs during the drawing of the carrier.

3. The method of claim 1 wherein said yarn is drawn between 1.5:1 and 9:1.

4. The method of claim 1 wherein said drawing step is a two-stage drawing step.

5. The method of manufacturing a composite yarn product comprising the steps of supplying a partially oriented carrier, subjecting said carrier to an in situ axial deformation, coating said carrier with a molten polymeric material while said carrier is subjected to said deformation, and applying an outer layer of yarn-forming material on said coated carrier while said polymeric material is tacky.

6. The method of claim 5 wherein the step of applying said outer yarn-forming material comprises the step of applying fibers to said coated carrier.

7. The method of claim 5 wherein the step of subjecting said carrier to in situ deformation comprises the steps of orienting said carrier prior to said coating step and subsequently subjecting the yarn to a twisting step.

8. The method of claims 1, 5 or 7 wherein said carrier is of a polyester material.

9. The method of claims 1, 5 or 7 wherein said binding material is a polypropylene.

10. The method of manufacturing a composite yarn product having a carrier which is subsequently coated with a binding material and an outer yarn component, said method comprising the steps of supplying a partially oriented carrier of partially oriented or undrawn material, subjecting said carrier to an in situ axial deformation including drawing the carrier and twisting the carrier, coating said carrier with a molten polymeric material while said carrier is subjected to said deformation or immediately just after said carrier has been subjected to said deformation, and applying an outer layer of yarn-forming material on said coated carrier while said polymeric material is tacky.

11. The method of claim 10 wherein the step of applying said outer yarn-forming material comprises the step of applying fibers to said coated carrier.

12. The method of claim 10 wherein said carrier if of a polyester material.

13. The method of claim 10 wherein said binding material is a polypropylene.

14. A composite yarn product comprising an inner carrier which is only initially partially oriented, a polymeric sheath about said inner carrier and an outer yarn component adhering to said polymeric sheath, said yarn product being made by the process comprising the steps of supplying a carrier of a partially oriented or undrawn material, drawing and orienting said carrier, and coated said carrier with a binding material just after or during the period of time that the carrier is being drawn and oriented.

15. The product of claim 14 wherein said polymeric material comprises a polypropylene vinyl acetate copolymer.

16. The product of claim 14 wherein said yarn is drawn between 1.5:1 and 9:1.

17. The product of claim 14 wherein said drawing step is a two-stage drawing step.

* * * * *